United States Patent [19]

Wille

[11] Patent Number: 5,011,724

[45] Date of Patent: Apr. 30, 1991

[54] SELF-ADHESIVE COVER FILM

[75] Inventor: Jürgen-Albin Wille, Hamburg, Fed. Rep. of Germany

[73] Assignee: Beiersdorf Aktiengesellschaft, Hamburg, Fed. Rep. of Germany

[21] Appl. No.: 360,512

[22] Filed: Jun. 2, 1989

[30] Foreign Application Priority Data

Jul. 1, 1988 [DE] Fed. Rep. of Germany ..... 3822186

[51] Int. Cl.[5] ..... B32B 7/14; B32B 7/12; B32B 3/04

[52] U.S. Cl. ..... 428/130; 428/194; 428/343; 428/181; 428/40

[58] Field of Search ..... 428/194, 343, 189, 153, 428/130, 181

[56] References Cited

U.S. PATENT DOCUMENTS

| | | | |
|---|---|---|---|
| 2,510,120 | 6/1950 | Leander | 428/191 |
| 2,803,578 | 8/1957 | Holland | 428/194 X |
| 4,587,152 | 5/1986 | Gleichenhagen et al. | 428/198 X |
| 4,590,109 | 5/1986 | Holmberg | 428/194 X |

FOREIGN PATENT DOCUMENTS 3334800 4/1985 Fed. Rep. of Germany .

*Primary Examiner*—George F. Lesmes
*Assistant Examiner*—D. R. Zirker
*Attorney, Agent, or Firm*—Sprung Horn Kramer & Woods

[57] ABSTRACT

Cover with a self-adhesive finish on one side and strip-like application of adhesive, characterized in that the cover is in the form of extensible folds and only one of the outer surfaces of the folded structure carries adhesive.

15 Claims, No Drawings

SELF-ADHESIVE COVER FILM

The invention relates to a self-adhesive cover with strip-like application of adhesive on one side, in particular to a cover film or cover paper.

Such cover films are known. Thus, German Patent Specification 3,334,800 describes a tarpaulin for covering building components, such as windows and doors, with an adhesive layer arranged on the inside in a strip-like grid and a special perforation for tearing off any tarpaulin parts which may protrude. U.S. Pat. No. 2,510,120 also describes a cover paper with a striplike application of adhesive, which paper is extensible up to a certain degree and is also suitable for irregular surfaces. German Utility Model 81 24,143 describes a peel-off, self-adhesive workpiece-protection film of plastic with stripes applied for ease of removal after covering and, if desired, for repeated use.

The known self-adhesive cover films have, however, considerable disadvantages. Thus, it is desired for large-area surface protection to use inexpensive thin films on the one hand but large widths, especially more than 1 m, on the other hand, in order to be able to cover large areas with one piece. For this purpose, however, the known cover films can neither be adequately handled nor produced on a large scale in conventional plant. Moreover, thin LDPE or HDPE films can conventionally hardly be coated, since they are sensitive to heat and petroleum spirit.

In order to counter the problems in handling very wide and thin cover films, folded cover films with self-adhesive edge region are also already available. A disadvantage of these films is, however, the large, non-adhesive film area which cannot be avoided with a product of this type and which is a great disadvantage in the use in practice in the case of wind, draught, sliding off or the like.

It was the object of the invention to overcome this drawback, in particular to avoid the disadvantages of the state of the art or at least to alleviate these, in particular to provide a self-adhesive cover with adhesive applied in stripes, which cover gives products useful in practice, even in large widths and with thin carrier films.

Accordingly, the present invention describes covers of the type indicated in claim 1, with advantageous embodiments according to the subclaims.

The covers according to the invention can be produced by means of suitable devices. Thus, known longitudinal folding devices can be used in order to fold up the carrier in zig-zag form, consisting of an unrolling station, in which the carrier is unrolled from a roll, the actual folding station with a width-expanding roller in front, and a rolling-up station in which the folded structure is wound up again to give a now substantially smaller roll. By bridging the rolling-up station, the folded carrier can advantageously be coated "in line" with adhesive, dried and rolled up in the folded state, and marketed in the form of rods in various lengths and widths.

Unrolling and application preferably correspond to the state of the art. The folding device consists, in particular, of mutually engaging upper plates and lower plates, which are parallel and inclined towards one another at an angle to the horizontal, in order to make it easier subsequently to lay the carrier flat. To allow folding, at least one set of plates should be in a wedge-shaped arrangement. The middle plate or the middle pair of plates of this wedge-shaped arrangement then has the longest plate with, in each case, two further but shorter plates arranged in pairs on both sides around the middle with an offset in the direction of running. When the carrier is pulled through the device, always the middle fold or the middle pair of folds is made first in each case, the width of the carrier becoming narrower corresponding to the fold width. When the first short pair of plates has been reached, two further folds are produced. Further plates, again shorter in pairs and arranged with an offset on both sides of the middle, then produce the next pair of folds. The remaining folds are produced in a comparable manner. This folding leads theoretically to a ratio of 1:3. Depending of the gaps, which may preferably may be present between the individual folds, the ratio can, however, rather reach a value of 1:2.5.

It is equally suitable to lay several folds side by side, by means of an appropriate vertical arrangement of the plates, and then to lead these together and to coat them with adhesive on one end face.

If desired, the folded carrier is provided with a primer and varnish and coated with a suitable self-adhesive compound. Coating methods for this purpose are screen-printing, in particular according to German Offenlegungsschrift 3,346,100 for products which are to be stuck together reversibly, and also in the conventional manner with adhesive compounds in solvents via stripe application, Acutrack or a Reco roller unit.

Apart from the embodiments preferred in the subclaims, the covers according to the invention with about 3–25 g of adhesive compound per $m^2$, in particular 5–10 $g/m^2$, or with adhesive points via screen-printing, such as are preferentially described in German Offenlegungsschrift 3,346,100, are particularly suitable. In this case, preferably about $\frac{1}{3}$ of the surface is coated so that about 3 m wide films can be processed in the case of a coating-machine width of 1 m.

In addition to a nonwoven fabric, woven fabric and preferably paper, a suitable carrier for the cover are, in particular, thin plastic films which are produced in single-ply or multi-ply, such as are characterized in more detail in the examples and subclaims.

Illustrative examples are given below, without intending to restrict the invention unnecessarily.

EXAMPLE 1

A 2 m wide HDPE film of 25 $\mu$ thickness is subjected to an accordion folding and laid in folds of 1 cm width each, the original width of 2 m being reduced to about 80 cm (theoretically: 67 cm). As described in Example 1 of German Offenlegungsschrift 3,346,100, this folded film carrier is coated by screen-printing with the adhesive compound described therein, with an applied weight of 5 $g/m^2$ and 80 mesh screen size. After drying in a drying tunnel at 60° C., the finished product is bound up to give a roll.

EXAMPLE 2

As described in Example 1, a 15 $\mu$ thick HDPE film is folded and coated, this time at 17 mesh screen size, again dried at 60° C. and bound up to give a roll.

EXAMPLE 3

As described in Example 1, a 50 $\mu$ thick LDPE film is folded and coated with 5 $g/m^2$ at 80 mesh screen size. It is dried at 60° C. and then bound up to give a roll.

I claim:

1. A sheet on one face having spaced parallel stripes of adhesive and adhesive-free stripes, the sheet being folded laterally to form longitudinal pleats, the inside of each pleat being substantially adhesive-free, whereby the sheet in folded form is covered on one face with adhesive but can be laterally extended to form a wider sheet with alternating adhesive-coated and adhesive-free stripes.

2. A sheet according to claim 1, wherein the sheet is a film, paper, or woven or nonwoven fabric.

3. A sheet according to claim 2, wherein the film is of polyolefin.

4. A sheet according to claim 3, wherein the polyolefin is polyethylene or polypropylene.

5. A sheet according to claim 4, wherein the film is HDPE or LDPE.

6. A sheet according to claim 1, the sheet being 10 to 100 $\mu$ thick.

7. A sheet according to claim 1, the sheet being 15 to 50 $\mu$ thick.

8. A sheet according to claim 1, wherein each adhesive stripe is fully covered with adhesive.

9. A sheet according to claim 1, wherein the adhesive is screen-printed onto the sheet and retains its adhesiveness upon adhesion to and removal from a surface.

10. A sheet according to claim 1, wherein the adhesive covers about 10 to 50% of the surface of the sheet in extended form.

11. A sheet according to claim 1, wherein the adhesive covers about 20 to 40% of the surface of the sheet in extended form.

12. A sheet according to claim 1, wherein the other face of the sheet has no anti-adhesive finish.

13. A sheet according to claim 1, at least 40 cm wide in unextended form.

14. A sheet according to claim 1, from 1 to 3 meters wide in unextended form.

15. A method of making a sheet according to claim 1, which comprises folding a sheet longitudinally to form a plurality of longitudinal pleats, applying an adhesive to one face of the folded sheet, and permitting said adhesive to set, dry or cure.

* * * * *